US005569489A

United States Patent [19]

Kasmark, Jr.

[11] Patent Number: 5,569,489

[45] Date of Patent: Oct. 29, 1996

[54] MACHINE AND METHOD OF MAKING A FILTER

[76] Inventor: James W. Kasmark, Jr., 38267 Fern Hill, Mt. Clemens, Mich. 48044

[21] Appl. No.: 466,485

[22] Filed: Jun. 6, 1995

[51] Int. Cl.[6] ..... B05D 1/36; B05D 5/00

[52] U.S. Cl. ..... 427/202; 118/63; 427/244

[58] Field of Search ..... 118/63; 427/202, 427/244; 428/221, 283, 288, 903, 913

[56] References Cited

U.S. PATENT DOCUMENTS

| | | | |
|---|---|---|---|
| 3,019,127 | 1/1962 | Czerwonka et al. | 117/33 |
| 3,914,822 | 10/1975 | Wood | 19/156.3 |
| 3,918,126 | 11/1975 | Wood | 19/156.3 |
| 3,972,092 | 8/1976 | Wood | 19/156.3 |
| 4,227,904 | 10/1980 | Kasmark, Jr. et al. | 55/316 |
| 4,755,178 | 7/1988 | Insley et al. | 428/283 X |
| 5,124,177 | 6/1992 | Kasmark, Jr. et al. | 427/202 |
| 5,338,340 | 8/1994 | Kasmark, Jr. et al. | 96/135 |

*Primary Examiner*—Michael Lusignan
*Attorney, Agent, or Firm*—Brooks & Kushman P.C.

[57] ABSTRACT

A random fiber web with a uniformly distributed sorbent particle is described. In order to provide a uniform distribution of the sorbent particle within the random fiber web, it is proposed to combine the sorbent particles and fibers in the web during its formation. The fibers are joined in such a way that the sorbent particles are secured within the web in a uniform distribution. The fibers are joined with the use of dry adhesives, UV hardenable adhesives, low melting fibers, spraying a liquid adhesive or needling. The invention also extends to a machine for making random fiber webs and a method of making a thin bed filter for removing odors and particulates.

31 Claims, 4 Drawing Sheets

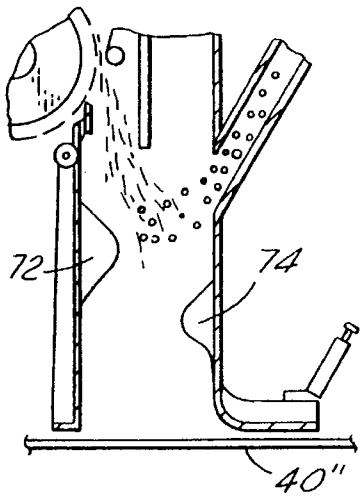
FIG. 4
FIG. 3
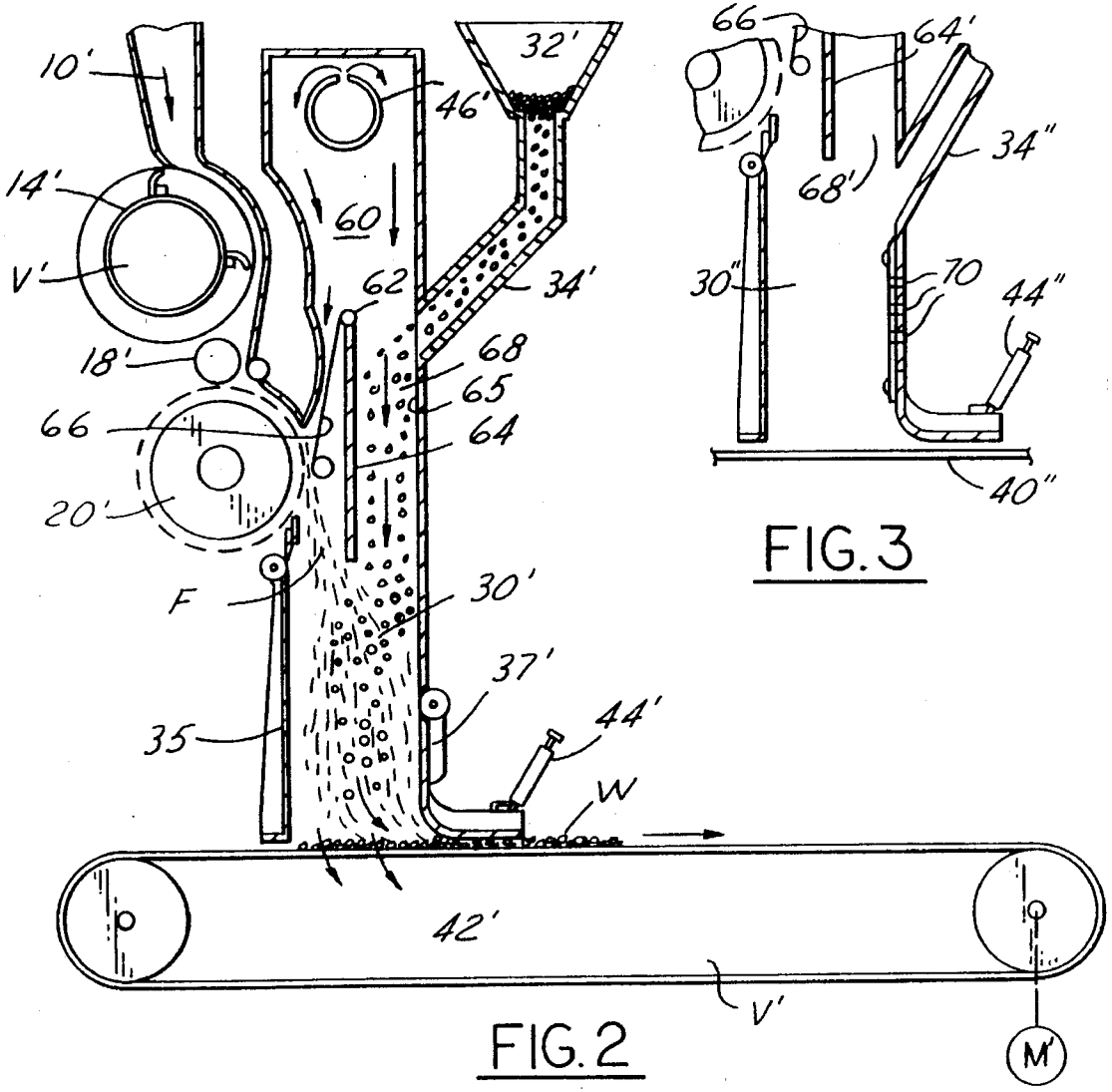
FIG. 2

MACHINE AND METHOD OF MAKING A FILTER

FIELD OF THE INVENTION

This invention relates to fluid filters and particularly, though not necessarily exclusively, to thin bed filters comprising a random fiber web having sorptive particles uniformly distributed through and locked in the web, and to methods of making such a web.

BACKGROUND OF THE INVENTION

For a sorptive type filter, i.e., one which filters by adsorption or absorption, of particulate material, maximum efficiency and life span are attained when the sorptive particles are packed together in a bed. For a thin bed filter, i.e., from less than ½" to 2 or more inches thick, this can be obtained by simply filling the space between two spaced apart perforated sheets with loose carbon particles. Such filters, herein referred to as "filled filters", have been manufactured and sold by D-Mark, Inc. of Chesterfield Township, Mich. as well as by others. While resulting in a high capacity filter, the particles tend to settle resulting in channelling and shedding of the sorptive particle dust such as carbon dust.

Shedding and channelling is overcome as disclosed in U.S. Pat. No. 3,019,127 but only a very low carbon loading results, somewhere on the order of 4% of particulate material per unit volume of the web. Increased carbon loading, while avoiding shedding and channelling, is disclosed in U.S. Pat. No. 4,227,904 wherein carbon particles are glued to the face of a perforated substrate to provide a layer of particles on the substrate. Two such substrates are then placed together with the carbon covered faces in opposition and a border frame is secured about the edges to hold the substrates together. This results in a medium loaded product which has enjoyed substantial commercial success.

Finally, heavily loaded thin bed filters which avoid channelling and the other drawbacks of the prior art and methods of making them are disclosed in U.S. Pat. Nos. 5,124,177 and 5,338,340. These filters have a maximum loading of approximately 90–100 grams per square foot with a ⅜" thick mat, and up to 300 grams per square foot with a mat approximately ¾" thick. These loadings have a very acceptable pressure drop, and with roll-coating, "driving" and/or rolling techniques, they have been able to achieve extremely good adhesion with a minimum of shedding during handling and final assembly. From a performance point of view, the carbon is not totally encapsulated during the manufacturing process, and therefore the vast majority is available for first pass absorption.

While such filters are enjoying commercial success, these products do not always contain a uniform loading of the particulate throughout the web or pad and the density or porosity may vary from pad to pad or throughout the same pad. This is not the fault of the methods disclosed in such patents, but rather the pad as received from the pad manufacturer varies. The prior art does not offer a solution that resolves the problem, and provides a uniform particulate loading in the pad. Accordingly, a different method of constructing the filter disclosed in U.S. Pat. No. 5,338,340 is needed, one that provides uniformity in loading and density of the finished filter, and which allows an increase in the loading.

SUMMARY OF THE INVENTION

It is an object of the present invention to provide a fluid filter having a fiber web which has a uniform distribution of sorptive particles.

It is another object to provide a method of locking sorbent or sorptive particles in a uniform distribution within a fiber web.

It is yet another object to provide a method of constructing a filter wherein the sorptive particles, such as carbon fines and/or dust do not shed downstream, a method that does not require the need for a carbon capturing filter layer.

In meeting the above object, advantages and features, the present invention is directed to a method of making a random fiber web having sorbent or sorptive particles distributed therethrough which includes the steps of: introducing fibers into an air stream; introducing sorbent particles into the air stream; mixing the particles and fibers in the air stream; and directing the air stream with contained fibers and sorbent particles against a foraminate condenser to form a sorbent containing random fiber web.

The invention also discloses a method of making a thin web filter from a sorbent containing random fiber web comprising the steps of: containing sorptive particles with an adhesive; introducing fibers into a moving air stream; introducing the sorbent particles and adhesive into the air stream; mixing the sorbent particles and adhesive with the fibers in the air stream; condensing the fibers and sorbent particles and adhesive in the air stream into a web; and treating the adhesive within the web to use sorbent particles to be retained in the web.

Additionally, the invention discloses a method for making a thin bed filter from a sorbent containing random fiber web having a first and second side comprising the steps of: introducing fibers into a moving air stream; introducing sorbent particles into the air stream; mixing the sorbent particles and fibers in the air stream; condensing the fibers and sorbent particles in the air stream into a web; and treating the web to cause the sorbent particles to be retained in the web.

The invention further discloses a machine for making a sorbent containing random fiber web.

Disclosed herein is a method of constructing a filter by inserting the sorptive particles into the web or pad at the time the web is being formed. Not only is uniformity in the final product achieved, but the filter may be made in one continuous process rather than first making the web and thereafter inserting the carbon. Such requires several separate steps which could be avoided if the sorptive particles are combined in the web simultaneously with its formation. In addition, by building the particulates into the web at the time of its formation, the amount and uniformity of the sorbent (carbon or other material) can be adjusted to increase or decrease. With this type of control the performance of the filter can also be controlled, allowing a wide range of products, from the "getter" type to HVAC, medical, industrial, automotive, aircraft and similar products.

With this improved process, first pass efficiency and capacity can be designed or controlled in the filter, and different sorptive particle sizes can be combined into one substrate. By using different denier fibers, a combination product is possible that would allow both gases to be absorbed or adsorbed and finite particles to be removed.

To carry out the disclosed method, processes shown in U.S. Pat. Nos. 3,194,822, 3,918,126 or 3,972,092, are incorporated herein by reference and modified as herein disclosed. More particularly, and with reference to U.S. Pat. No. 3,972,092 (hereafter the '092 patent) this invention introduces into the air stream passing down through the duct 310 past the lickerin 303 and through the duct 324, sorptive particles of the type and size one wishes to have in the web.

After the sorptive particles are introduced, such particles are mixed in the air stream with the fibers, and collected on an endless condensing screen conveyor 326 to form a loose web of randomly arranged fibers with the sorbent particles uniformly distributed therethrough. Thereafter the loose web is treated to lock the fibers together and the sorbent particles therein. Utilizing the teachings of U.S. Pat. No. 3,914,822 multiple lickerins and correspondingly different denier or length fibers may be incorporated in the web to vary the characteristics thereof and/or the retention of the sorptive particles therein. Sorptive particles of different types and sizer may be introduced in the same air stream to provide different sorptive actions in the filter web being formed.

The treatment of the web to lock the fibers together and the sorptive particles therein may involve spraying adhesive on the web with or without subsequent rolling thereof, or the fibers may be precoated with an adhesive before entering the lickerin and the adhesive then activated by ultraviolet light or heat in the web. Dow melting fibers may be used and UV hardenable adhesives may be introduced and then cured. Needling of the web may also be utilized to lock fibers together and the sorptive particles therein. If desired, the needling may be utilized in combination with the application of adhesive.

BRIEF DESCRIPTION OF THE DRAWINGS

FIG. 2 is a schematic view of a modified form of the apparatus shown in FIG. 1;

FIG. 3 shows a detail of the expansion chamber or duct of the apparatus of either FIGS. 1 or 2 at the endless condenser screen;

FIG. 4 is similar to FIG. 3 with arrangements for accelerating the air flow in the expansion chamber at the point of mixing the fibers and sorptive particles to improve mixing thereof;

BRIEF DESCRIPTION OF PREFERRED EMBODIMENTS

Figure 1:
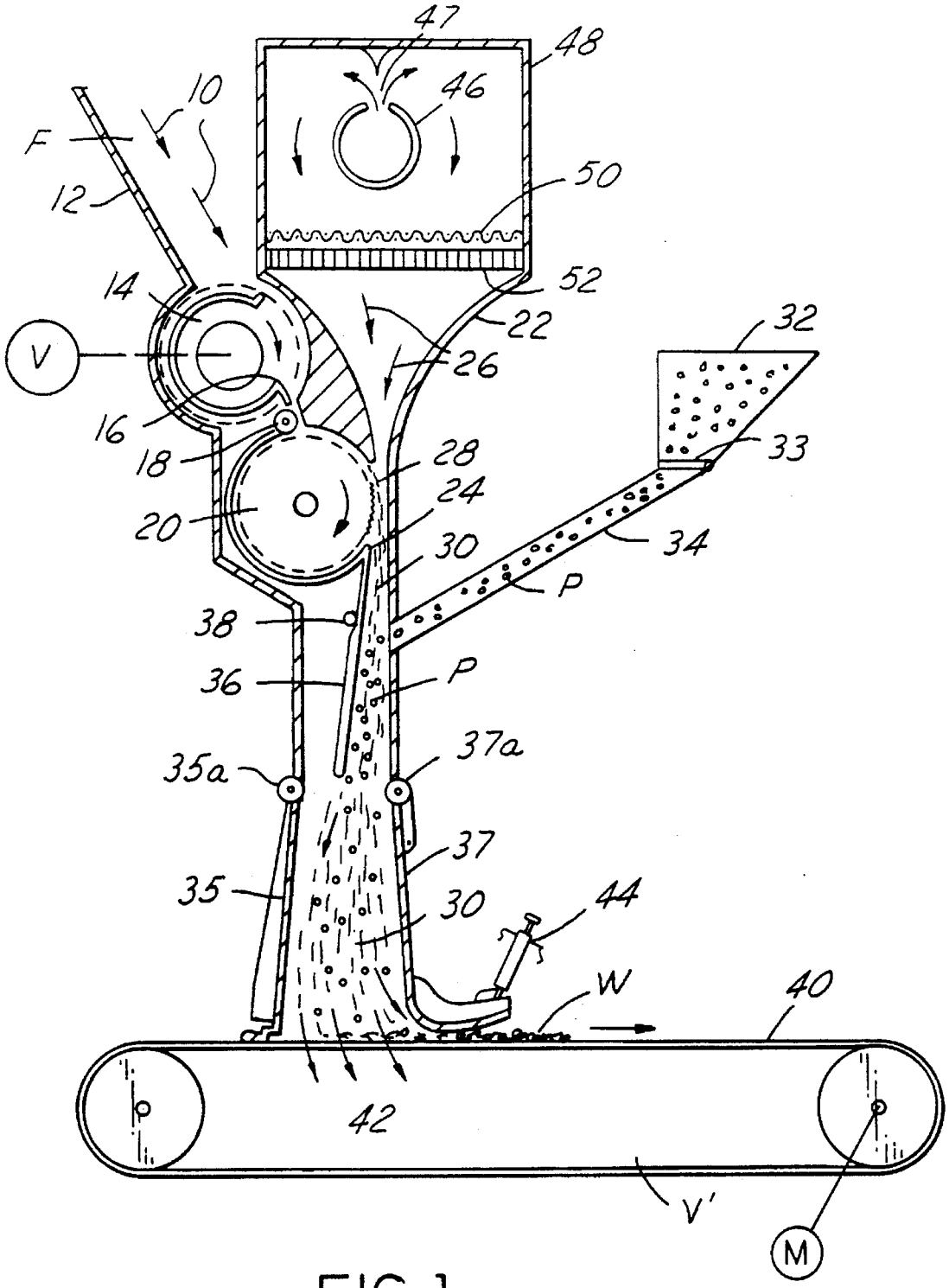
FIG. 1 is a schematic view of a portion of the machine shown in FIG. 6 of U.S. Pat. No. 3,972,092 modified to carry out the method described herein.
Figure 6:
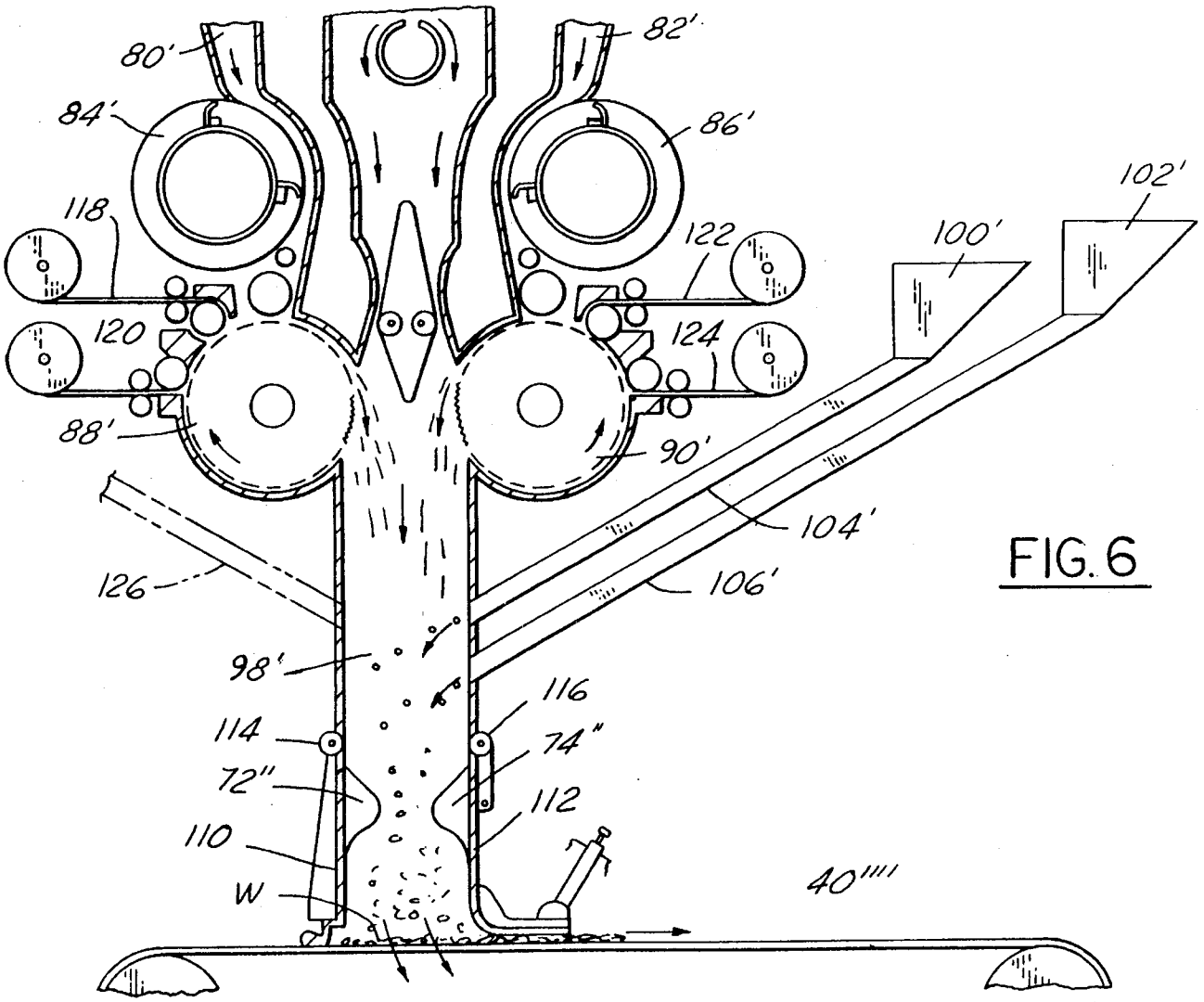
FIG. 6 shows a modification of the apparatus of FIG. 5.

FIG. 1 depicts a schematic drawing, similar to FIG. 6 of U.S. Pat. No. 3,972,092, a portion of a machine for forming a random fiber web W. Reference should be made to such patent for details of construction and operation of the machine. Fibers F for making the web are introduced in the direction of arrows 10 into a duct 12 which communicates with a rotating condensing roll 14 having a foraminous periphery through which air is drawn by a partial vacuum V to form the fibers into a mat at the periphery of the roll. The mat (not shown) on the periphery of the condensing roll 14 is removed therefrom by a doffing bar 16 and delivered by a feed roll 18 to the rotating lickerin 20. The teeth of the lickerin separate the fibers and by a combination of the high speed of the lickerin creating a strong centrifugal action, doffing by a doffing bar 24 and the movement of an air stream 26 passing over the face of the lickerin in the throat area 28 causes the fibers to fly off the lickerin 20 and become airborne in the air stream.

The air stream is contained in a duct 22 of generally venturi shape which extends across substantially the width of the machine. The lickerin and the other rolls are coextensive therewith. The fibers enter the air stream at the throat area 28 of the venturi shaped duct. The entrained air borne fibers move with the air stream into an expanding area 30 of the duct where they mix with sorbent particles P introduced into the duct transversely across the width of the duct (i.e. the machine) from a hopper 32 through one or more feed pipes 34 extending through the side wall of the duct. The hopper and/or feed pipe may be vibrated as needed to induce proper feed of the particles. A movable gate 33 may be provided at the bottom of the hopper to control the flow rates of the sorptive particles.

The location at which the particles enter the duct may be varied as desired. For example, the feed tubes may enter the duct farther up, closer to the lickerin 20, as long as the particulate does not adversely contaminate the lickerin. A movable wall 36 opposite the exit of the feed tubes 34 is pivoted at 38 and may be positioned as desired to vary the rate of expansion of the air stream in the expansion chamber to modify the mixing of the fibers and the sorptive particles.

At the lower end of the expansion chamber an endless condensing screen conveyor 40 having a suction chamber 42 therein draws the air stream with its airborne fibers and sorptive particles against the screen conveyor to form a loose random fiber web W thereon. The loft or thickness of the web may be controlled by thickness control 44 as discussed in U.S. Pat. No. '092.

Adjustable air jets or atmospheric air inlets (see openings 70 in FIG. 3) may be provided in the walls of duct 22 at one or more suitable point along its length as required for adequate mixing of the fibers and sorptive particles. In addition, the hopper 32 may have its interior exposed to atmospheric air, or superatmospheric pressure or sealed from atmospheric pressure as desired to vary the feed of particles into the duct or control entry of air into the duct with the particles.

Side walls 35 and 37 of the duct are adjustable toward and away from each other to adjust the air flow and mixing of the fibers and sorptive particles. The adjustment of these walls, the location of supplementary air inlets in the walls of the duct, the location of the entry point of the particle tube or tubes 34 through the wall of the duct are all related to the objective of effecting a uniform mixing of the sorptive particles and fibers so that the final web will have the particles uniformly distributed therethrough. In addition, these adjustments in flow rate of the air stream and the volume of sorbent particles introduced allow variations in the sorbent loading of the web being formed. Thus the greater the quantity of the sorbent particles introduced into the air stream in a given time interval the greater the loading of the resulting web, and vice versa. The particle loading expected to be produced by the methods disclosed herein should be at least similar to those produced by the methods of U.S. Pat. No. 5,338,340 and theoretically even greater.

As described in U.S. Pat. No. '092, suction air from the condenser 42 may be returned to the air tube 46 from which it exits through a slot 47 within a feed plenum 48 having distribution screens 50 and 52 through which the air enters duct 22.

In practicing the method, it is desirable to screen all sorptive particles prior to filling the feed hopper 32 to eliminate fines from the air system of the machine, and to isolate air used in the fiber feed side of the apparatus, i.e., the air used in delivering the fibers F as at arrows 10, and on through the condenser roll and the lickerin 20, from the air circulating in the plenum 48 and the endless condenser chamber 42, to avoid contaminating the lickerin and other condenser rolls 14.

Carbon and other sorptive particles useable in the methods disclosed herein may be on the order of from 4/6 or 6/16 mesh down through 20/50 particles. Much finer particles may be utilized, such as powders in the 300/400 mesh range. In connection with carbon particles, blends may be utilized to combine a very high first pass efficiency (small carbon) with larger carbon particles which would offer long life, capacity, and higher retentivity.

FIG. 2 depicts an apparatus generally similar to that of FIG. 1. In FIG. 2, for simplicity, the plenum box 48 with its screens 50 and 52 have not been shown. Primed reference numerals within FIG. 2 indicate corresponding parts from FIG. 1.

Air from the delivery tube 46' moves downwardly through duct 60 and splits at the apex 62 of the air divider 64, a portion passing between the adjustable divider wall 66 and the lickerin 20' with fibers F becoming airborne and entering the mixing and expansion chamber. The other portion of the downwardly moving air passes through a particle entrainment chamber 68 between the air divider 64 and the opposed wall 65 of the duct where the sorbent particle delivery tube or tubes 34' opens into the duct.

While FIG. 2 depicts the tube 34' located substantially opposite the apex of the air divider, it should be understood that the tube may be positioned lower down along the duct as shown in FIG. 3 where it is substantially opposite the lower end of the divider. By varying the pivoted position of the air divider 64 the cross-section of the entrainment chamber 68 may be varied to increase or decrease the air velocity and velocity of the sorptive particles as they enter the mixing chamber 30' where they commingle with the fibers F. The wall 66 may also be pivotally adjusted about the apex 62 to vary the air speed across the lickerin 20' and thus vary the fiber introduction into the mixing chamber.

Walls 35' and 37' may be adjusted toward and from each other to vary the mixing action in the chamber 30'. As with the FIG. 1 embodiment, the fibers and sorptive particles are deposited on the endless condenser 40' which is driven by the motor M' to thereby form the loose web W which is then treated to lock the fibers together and lock the sorptive particles therein.

As shown in the modification in FIG. 3, atmospheric air may be introduced into the duct 30" at the adjustable ports 70. In FIG. 4 accelerator bumps 72 and 74 are shown which "push" the sorptive particles into the air stream and increase the mixing with the fibers. As pointed out in U.S. Pat. No. '092 the thickness of the fiber stream as it passes downwardly through the mixing and expansion chamber should not exceed more than about 12 to 25 μm as it approaches the condenser screen 40".

Figure 5A:
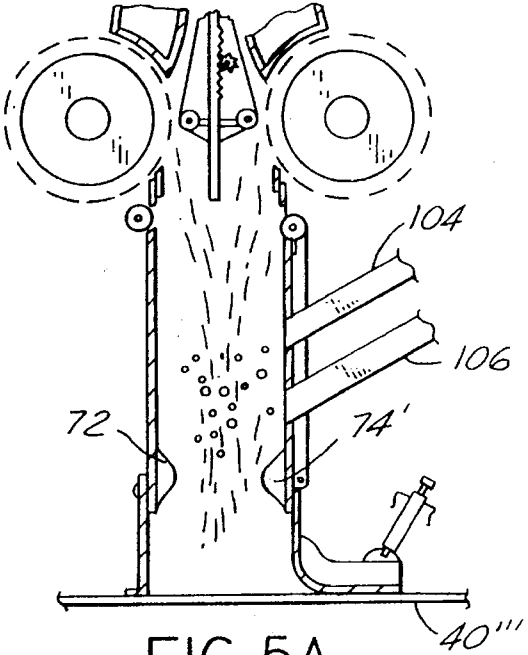
FIG. 5A shows a detail of the expansion chamber of FIG. 5.
Figure 5:
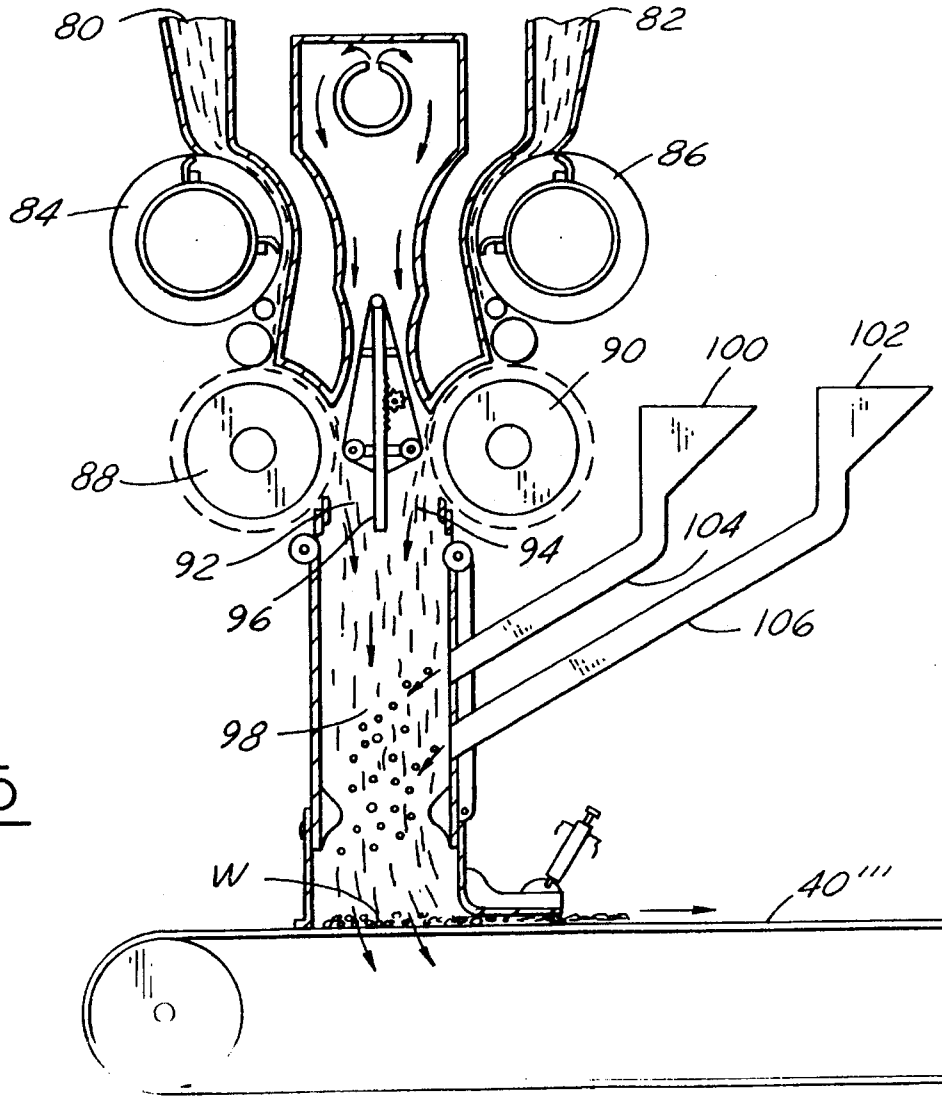
FIG. 5 is a schematic view of a portion of the machine shown in FIG. 1 of U.S. Pat. No. 3,914,822 modified to carry out the method described herein.

In FIG. 5 apparatus of the kind shown in U.S. Pat. No. 3,914,822 is shown, modified to enable the formation of a web from two different length and/or denier fibers and two different size and/or types of sorptive particles. Assuming an understanding of the machine disclosed in U.S. Pat. No. 3,914,822 the different fibers are delivered to the machine through the infeed chutes 80 and 82 which correspond generally to ducts 10 and 12 of such patent. The fibers are first matted on the condenser rolls 84 and 86 and are delivered to the lickerins 88 and 90 as disclosed in the patent where the fibers are doffed into the air streams 92 and 94 on opposite sides of the air splitter 96 and then enter the mixing and expansion chamber 98. If the apparatus is to form a web containing carbon particles of two different sizes, the particles are placed in the two bins 100 and 102 having feed tubes 104 and 106 which open into the mixing chamber one above the other as shown. As with the FIG. 1 embodiment, the hoppers 100 and 102 and the feed tubes 104 and 106 may be vibrated, and moveable gates may be provided to control the feed rate and ensure proper mesh size. For example particles of a 6/8 mesh may be placed in one bin and particles of a 20/50 size in the other. These particles may then combined with the fibers in whatever ratio desired by merely controlling the feed from the bins. As before, the web is formed on an endless condenser screen 40 and which is thereafter treated to lock the fibers and particles in the web.

In FIG. 5A the lower end of the expansion chamber of FIG. 5 is shown having been modified by the addition of air accelerating bumps 72' and 74' whose action is similar to that of the bumps in FIG. 4.

FIG. 6 shows an apparatus based on the disclosure of FIG. 5 of U.S. Pat. No. 3,918,126 modified as hereinafter described. This apparatus is designed to blend different sizes or types of sorbents with two dissimilar fibers to form a uniform nonwoven filter/sorbent web. The sorbents are added to the air stream below the lickerins 88' and 90' as by the vibrated tubes 104' and 106' delivering sorbent particles from associated hoppers or bins 100' and 102'. Fibers are fed into the machine at 80' and 82' pass to the condensing rolls 84' and 86' and from there to the lickerins 88' and 90' and thence doffed into the expansion chamber 98' where they are mixed randomly together and with the sorptive particles from the hoppers 100' and 102'. To assist the mixing and promote uniformity of the resulting product, accelerator bumps 72" and 74" may be provided. In addition, the walls 110 and 112, hinged at 114 and 116, may be adjusted toward and from each other to vary the expansion of the entrained fiber/sorbent air stream. Fibers different from those entering at 80' and 82', or wood pulp or other fibrous product may be fed to the lickerins 88' and 90' as at 118, 120, 122 and 124 to provide a random fiber web of virtually any desired characteristic. With the diversity of fibers possible with this arrangement, a contaminant particle and odor removing filter web may be easily formed, combining in it a single pass filter based on the use of a fine mesh carbon particle, for example. Other variations will readily occur to those skilled in the filter art.

Shown in phantom outline at 126 is yet another vibratory tube which may be optionally utilized to deliver a different sorbent to the mixing chamber than those from tubes 104' or 106'. Sorbents from all tubes need not be delivered simultaneously to the mixing chamber, but rather may be selectively delivered in accordance with the requirements of the filter web to be produced.

Various kinds of sorbents may be utilized in the methods and apparatus herein disclosed. Carbon particles, oxidizing agents, Zeolites, activated aluminum impregnated with potassium permanganate, molecular sieves, or combinations of these materials with or without carbon could be blended for specific applications. Blends of carbons, and/or impregnated carbons could also be utilized for specific applications, efficiency, capacity, or life.

After the web has been formed on the endless condenser screen 40, it is very fragile and must be treated to lock the fibers together and the sorbent particles therein, thereby allowing it to be handled, cut and used in a filter. This locking of the fibers of the web together may be carried out in several ways as explained hereinafter.

According to one method of locking the web fibers together, the web may be sprayed on one side with an adhesive, then processed through a curing over, turned over and sprayed on the other side and then again passed through either the same or a second oven. Spraying techniques are disclosed in U.S. Pat. No. 5,338,340 (U.S. Pat. No. '340 ) which is incorporated herein by reference. Adhesives which may be suitable for this purpose are also disclosed in the U.S. Pat. No. '340. A suitable adhesive for use with the spraying application is a PVAC-polyvinylacitate latex formulation. This is termed a cross-linking polymer 50% water content which cures at 325° F. in about one minute. The adhesive is available from National Starch or Sequa Division of Sun Chemicals. It is a common material used in the trade for bonding non-woven fibers.

In a second method the fibers may be locked together by treating the fibers with an adhesive or resin prior to forming the web. Adhesives suitable for this method can vary in size from granular adhesives to powder adhesives. In one embodiment, "Microthene" a product of Quantum U.S.I. based in Cincinnati, Ohio may be utilized. Microthene is a dry, polyolefin-based adhesive that has spherically shaped particles ranging from 20 microns to 40 microns. Microthene may be combined with the sorptive particles. Accordingly, the microthene particles can be fed into hopper 32 and thus transported through one or more feed pipes 34 which would then carry both the sorptive particles and the microthene particles to the expanding area 30 of the duct where the fibers would be mixed with the sorptive and microthene particles.

The benefit associated with the use of microthene particles is that by using such a fine, dry adhesive the adhesive does not settle to the bottom to the extent that a denser adhesive would likely settle. As a result, the microthene particles remain dispersed randomly throughout the Web as it is formed. During the curing stage, the microthene adhere to lock in the sorptive particles within the fiber web. The use of a dry adhesive also eliminates the need for spraying of an adhesive or needling processes and the like. In sum, the use of a dry adhesive during the formation of a web results in a more uniformly loaded web with sorptive particles locked within the matrix of fibers.

After the web is formed utilizing such treated fibers with the sorptive particles distributed therethrough, bonding of the fibers together and securement of the particles therein may be effected by a combination of heat, light and/or pressure and a finished web or mat can be made that will be superior to the one formed by spraying. This form of product would be uniform even with regard to the amount of adhesive therethrough and would have improved first pass absorption properties and lower pressure drop since the only adhesive on the carbon would be at the point where it touched or bonded to the fibers.

A fourth method of locking the fibers together is to needle punch the web. This approach is more feasible with smaller carbon such as 20/50 mesh and finer denier fibers such as 6 to 15 denier, since these particles will tend to be pushed aside by the needles as they penetrate the web. The process need not utilize any adhesive and therefore may be the best from the point of first pass absorption efficiency. The needling will increase the pressure drop but this should be well within acceptable ranges to obtain the highest possible adsorption efficiency.

In a fifth method, a UV hardenable solventfree prepolymer binder composition, such as that disclosed in U.S. Pat. No. 4,300,968 (U.S. Pat. No. '968), may be applied to the fibrous web. The U.S. Pat. No. '968 is incorporated herein by reference. As disclosed in the U.S. Pat. No. '968, a UV prepolymer binder composition can include a combination of a prepolymer and a thinner for the prepolymer. Suitable prepolymers include low molecular weight polyurethane, polyester or polyepoxy prepolymers. Suitable thinners include tri- or tetrafunctional acrylate monomers or multifunctional acrylate oligomers. The prepolymer binder composition may be cured by exposing the treated fibrous web to ultraviolet light.

One advantage of using UV light is that the binder is solidifed upon irradiation in its original plane, such that no web delamination occurs. The application of the binder can thus be readily controlled. For the present invention, the UV binder can be applied in stages onto the fibrous web or alternatively applied to the external surfaces of the fibrous web when it is fully formed. In the former case, the mixture of sorptive particles and fibers can be dropped onto the conveyor in stages, such that only a part of the overall fibrous mixture is released at one time. Following each partial release of the fibrous mixture, the UV binder is applied and immediately cured. This two-step partial release step process occurs until the fibers and sorptive particle mixture are fully dropped down and the UV binder is fully dispersed and cured within the fibrous web. With the latter method, after the web is fully formed, the UV binder may be applied to the external surfaces and cured to provide additional strength thereto.

In an additional method, the fibers can include low melting fibers which when activated by heat have a lower melting temperature than the other fibers. Upon application of heat, the low melting fibers adhesively bond to connect the fibers to one another and lock in the sorptive particles. U.S. Pat. No. 4,917,943 discloses low melting fibers for use within a fiber containing aggregate to place a mixture of spherically entangled fibers into a desired form and bond the fibers together. The low melting fibers can be made of a low melt thermoplastic material such as polyester, polyethylene and polyamide. U.S. Pat. No. 5,301,400 teaches the use of a three-dimensional non-woven fabric with a thermally adhesive surface for covering a fibrous mat. The U.S. Pat. No. '400 provides a specific example of a satisfactory low melt polyester fiber, sold by Du Pont Canada Inc,. under the code D1346.

The invention has been described in terms of specific embodiments set forth in detail herein. It should be understood, however, that these are by way of illustration only and that the invention is not necessarily limited thereto. Modifications and variations will be apparent from this disclosure and may be resorted to without departing from the spirit of the invention, as those skilled in the art will readily understand. Accordingly, such variations and modifications are considered to be within the scope of this invention and the following claims.

I claim:

1. A method of making a random fiber web with sorbent particles distributed therethrough comprising the steps of:

introducing fibers into an air stream;

introducing sorbent particles into the air stream containing the fibers at an area downstream from the point at which the fibers are introduced;

mixing the particles and fibers in the air stream; and directing the air stream with entrained fibers and sorbent particles against a foraminate condenser to form a sorbent containing random fiber web.

2. The method of claim 1, wherein at least two different types of fibers are introduced into the air stream.

3. The method of claim 1, further comprising the step of causing a turbulent flow in the air stream and injecting the sorbent particles into the turbulent air flow.

4. The method of claim 1, wherein following introduction of the sorbent particles into the air stream, the air stream is accelerated to increase the mixing of the particles in the air stream.

5. The method of claim 1, wherein the sorbent particles are introduced into the air stream at multiple locations.

6. The method of claim 1, wherein the rate of introduction of the sorbent particles into the air stream is varied to alter the sorbent loading of the web being formed.

7. The method of claim 1, wherein at least two different types of sorbent particles are introduced at different locations into the air stream.

8. The method of claim 1, wherein the fibers are introduced into the air stream by doffing the fibers from a rotating lickerin.

9. The method of claim 8, wherein at least two different types of fibers are doffed from different rotating lickerins into the air stream.

10. A method of making a thin bed filter comprising the steps of:

combining sorbent particles with an adhesive;

introducing fibers into a moving air stream;

introducing the sorbent particles and adhesive into the air stream containing the fibers at an area downstream from the point at which the fibers are introduced;

mixing the sorbent particles and adhesive with the fibers in the air stream;

condensing the fibers and sorbent particles and adhesive in the air stream into a web; and treating the adhesive within the web to cause the sorbent particles to be retained in the web.

11. The method of claim 10, wherein the adhesive is a dry adhesive selected from the group consisting of polyolefin based adhesives.

12. The method of claim 11, further comprising the step of heating the web to activate the dry adhesive to cause the fibers to adhere to each other and the sorbent particles to retain the sorbent particles in the web.

13. The method of claim 10, wherein the step of introducing the fibers into a moving air stream further comprises, separating the fibers by doffing the fibers from a rotating lickerin.

14. A method of making a thin bed filter having a sorbent containing random fiber web comprising the steps of:

doffing fibers from a mat of adhesively coated fibers and introducing them into an air stream;

introducing sorbent particles into the air stream containing the fibers at an area downstream from the point at which the fibers are introduced;

mixing the adhesively coated fibers and sorbent particles in the air stream;

directing the air stream against a foraminate condenser to accumulate a web thereon comprising fibers and sorbent particles; and treating the web to cause the adhesively coated fibers to adhere to each other and the sorbent particles, such that the sorbent particles are retained in the web.

15. A method of making a thin bed filter having a sorbent containing random fiber web comprising the steps of:

introducing fibers into a moving air stream, wherein at least a portion of the fibers are low melting fibers;

introducing sorbent particles into the air stream containing the fibers at an area downstream from the point at which the fibers are introduced;

mixing the sorbent particles and fibers in the air stream;

directing the air stream with entrained fibers and particles against a foraminate condenser to form a sorbent containing random fiber web; and treating the web to secure the sorbent particles therein.

16. The invention as defined in claims 1, 10, 14 or 15 wherein the fibers are introduced into the air stream at a venturi throat.

17. The invention defined by claims 1, 10, 14 or 15 wherein the sorbent particles are introduced into the air stream containing the fibers at an expansion area downstream from the point at which the fibers are introduced.

18. The method of claim 15, wherein the low melting fibers are selected from the group consisting of polyesters, polyethylenes and polyamides.

19. The method of claim 15, wherein the step of treating the web further comprises, applying adhesive to the web to secure the sorbent particles within the web.

20. The method of claim 19, wherein the step of treating the web further comprises, heating the web to cure the adhesive and secure the sorbent particles within the web.

21. A method of making a thin bed filter having a sorbent containing random fiber web comprising the steps of:

introducing fibers into a moving air stream;

introducing sorbent particles into the air stream;

mixing the sorbent particles with the fibers in the air stream;

condensing the fibers and sorbent particles in the air stream into a web;

applying a UV hardenable prepolymer binder composition onto the web to cause the sorbent particles to be retained in the web; and curing the UV prepolymer binder with the application of UV light.

22. The method of claim 21, wherein the UV prepolymer binder further comprises: a prepolymer, selected from the group consisting of low molecular weight polyurethanes, polyesters and polyepoxy prepolymers, and a thinner selected from the group consisting of trifunctional acrylate monomers, tetrafunctional acrylate monomers and multifunctional acrylate oligomers.

23. A method of making a thin bed filter from a sorbent containing random fiber web comprising the steps of:

introducing adhesively coated fibers into a moving air stream;

introducing sorbent particles into the air stream;

mixing the sorbent particles with the adhesively coated fibers in the air stream;

condensing the adhesively coated fibers and sorbent particles in the air stream into a web; and treating the adhesive within the web to cause the sorbent particles to be retained in the web.

24. A method of making a thin bed filter from a sorbent containing random fiber web having a first and second side comprising the steps of:

introducing fibers into a moving air stream;

introducing sorbent particles into the air stream containing the fibers at a point downstream from the point at which the fibers are introduced;

mixing the sorbent particles and fibers in the air stream;

condensing the fibers and sorbent particles in the air stream into a web; and treating the web to cause the sorbent particles to be retained in the web.

25. The method of claim 24, wherein the step of treating the web further comprises needling the web.

26. The method of claim 24, wherein the step of treating the web further comprises: spraying the first side of the web with an adhesive; curing the adhesive on the first side of the web; spraying the second side of the web with the adhesive; and curing the adhesive on the second side of the web.

27. The method of claim 26, wherein the adhesive is a PVAC-polyvinylacitate latex formulation.

28. The method of claim 24, wherein following the condensing of the fibers and sorbent particles into a web, pressure is adjustably applied to the web to control the height and density of the web.

29. A method of making a thin bed filter for removing both odors and particulates comprising the steps of:

doffing fibers of different characteristics from different rotating lickerins into an air stream, the fibers from at least one lickerin being adapted for removing air borne particulates;

introducing sorbent particles into the air stream containing the fibers at a point downstream of the introduction of the fibers;

mixing together the sorbent particles and the fibers of different characteristics in the air stream;

directing the air stream and entrained fibers and particles against a foraminous condenser to create a web; and treating the web to lock the sorbent particles therein.

30. A machine for making a sorbent containing random fiber web comprising, in combination:

a lickerin and fiber doffing mechanism;

apparatus for delivering fibers to the lickerin;

a venturi duct having an entrance end, a throat and an expansion chamber;

apparatus for inducing an air flow through the venturi duct;

a lickerin and fiber doffing mechanism arranged to doff fibers into the throat of the venturi duct when there is an air flow through the duct;

a source of sorbent particulate material arranged to deliver and introduce such particles into the venturi duct downstream of the point of introduction of the fibers; and an endless condenser arranged to receive an air stream with airborne fibers and sorbent particles from the expansion chamber of the venturi duct and form a random web mat containing the sorbent particles.

31. The invention defined by claim 30 wherein the source of particulate material is arranged to introduce the sorbent particulate into the venturi duct adjacent the lickerin but at a location where the sorbent particulate will not contact the lickerin.

* * * * *